US005317002A

United States Patent [19]

Onishi

[11] Patent Number: 5,317,002

[45] Date of Patent: May 31, 1994

[54] THERMAL TRANSFER SHEET AND THERMAL TRANSFER RECORDING METHOD

[75] Inventor: Hiroshi Onishi, Hirakata, Japan

[73] Assignee: Matsushita Electric Industrial Co., Ltd., Osaka, Japan

[21] Appl. No.: 31,501

[22] Filed: Mar. 15, 1993

[30] Foreign Application Priority Data

Mar. 16, 1992 [JP] Japan ..... 4-057700

[51] Int. Cl.[5] ..... B41M 5/035; B41M 5/38

[52] U.S. Cl. ..... 503/227; 156/235; 156/240; 428/195; 428/484; 428/520; 428/913; 428/914

[58] Field of Search ..... 8/471; 428/195, 913, 428/914, 484, 520; 503/227; 156/235, 240

[56] References Cited

U.S. PATENT DOCUMENTS 4,914,079 4/1990 Takei et al. ..... 503/227

*Primary Examiner*—B. Hamilton Hess

*Attorney, Agent, or Firm*—Wenderoth, Lind & Ponack

[57] ABSTRACT

The present invention relates to thermal transfer recording technique in which a thermal transfer sheet containing a dye is heated according to image signals.

There is provided a thermal transfer sheet with laminated in this order an ink layer containing a dye, a dye-diffusion preventive layer composed of an aqueous material and a particle-transfer layer composed of a softening transfer-material and dye acceptor particles of a dyeable thermoplastic resin dispersed therein.

Also disclosed is a thermal transfer recording method in which the softening transfer-material is softened according to image signals so that the softening transfer-material and dye acceptor particles are dyed with the dye contained in the ink layer, whereupon image transfer to an image receiving medium can take place.

8 Claims, 5 Drawing Sheets

THERMAL TRANSFER SHEET AND THERMAL TRANSFER RECORDING METHOD

BACKGROUND OF THE INVENTION

1. Field of the Invention

The present invention relates to a hard copy technique wherein coloring materials are arranged on an image receiving medium such as paper and the like according to image signals, and more particularly to a recording technique involved in a thermal transfer recording system.

2. Description of the Prior Art

Recently, attention has been drawn to a thermal transfer recording system of sublimation type which employs a thermal transfer sheet having a heat-resistant sheet-form substrate and an ink layer containing a sublimative dye, and an image receiving medium having a dye acceptor layer for receiving the dye as it is diffused thereinto by heating from the back of the thermal transfer sheet, since the system exhibits excellent medium tone-recording performance and provides full-color image records, as described in, for example, IEEE Transactions on Consumer Electronics, Vol. CE-28, No. 3, pp. 226–232, Aug. 1982, and Journal of Imaging Science, Vol. 35, No. 4, pp. 263–273, Aug. 1991.

With such a thermal transfer recording system of sublimation type, the process of recording is carried out in such a way that the ink layer on the thermal transfer sheet and the dye acceptor layer on the image receiving medium, as placed in superposed relation, are first heated by a thermal head from the sheet-form substrate side of the thermal transfer sheet according to a signal from a recording signal source. During this heating, dye is diffused into the dye acceptor layer from the ink layer in proportion to the quantity of heat applied so that subsequently when the thermal transfer sheet is separated from the image receiving medium, the dye acceptor layer will have a visible image formed therein by the diffusion-transferred dye.

A thermal transfer sheet for use with such thermal transfer recording system of sublimation type is constituted of a sheet-form substrate formed of a polyethylene terephthalate (PET) film or the like having a thickness of, for example, about 9 μm, and an ink layer formed by a solvent coating method on the surface of the sheet-form substrate, the ink layer containing 10 parts by weight of a styrene acrylic resin as a binder and 6 parts by weight of a sublimating disperse-dye. An image receiving medium for use in such system is constituted of a base formed of, for example, polyester or wood free paper, and a dye acceptor layer of a polyester resin which is formed on the surface of the base.

However, the above described system, which is adapted for utilization of thermal diffusion of dye into the dye acceptor layer, has such disadvantage that the system is generally unable to effect recording on a pulp-based paper such as papeterie paper or postcard paper, that is, on an image receiving medium having no dye acceptor layer.

SUMMARY OF THE INVENTION

It is an object of the present invention to provide a thermal transfer sheet which makes it possible to obtain a high quality image with gradation in which the phenomenon of dye diffusion is well utilized even when an image receiving medium has no dye acceptor layer, such as a pulp-based paper, and a method of production of the thermal transfer sheet and a method of thermal transfer recording in which the thermal transfer sheet is employed.

DETAILED DESCRIPTION OF THE INVENTION

Figure 1:
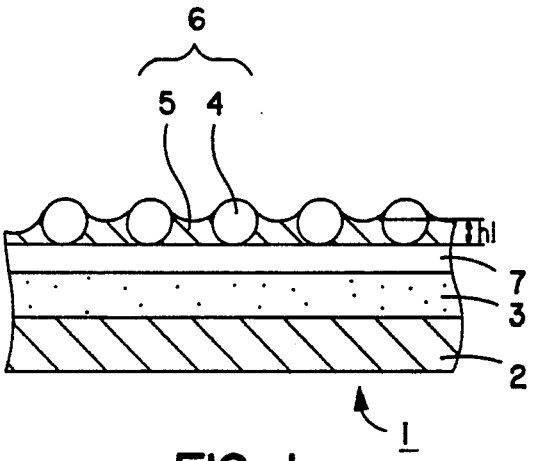
FIG. 1 is a schematic sectional view of a thermal transfer sheet embodying the present invention.

In order to accomplish the above object, according to the present invention there is laminated in this order a thermal transfer sheet comprising a heat resistant sheet-form substrate, an ink layer containing a dye, a dye-diffusion preventive layer formed of an aqueous material, and a particle-transfer layer comprising at least a softening transfer-material whose viscosity will be lowered by heating, and dye acceptor particles of a dyeable thermoplastic resin dispersed in the softening transfer-material.

When a thermal transfer sheet of the above described constitution, as pressed against an image receiving medium, such as pulp-based paper, is subjected to heat for thermal transfer recording, the softening transfer-material decreases in viscosity at a time when it is heated to a temperature above the transition point of the softening transfer-material. A part of the softening transfer-material whose viscosity has been lowered penetrates into the dye diffusion preventive layer in the direction of thickness thereof until it reaches the ink layer. The dye in the ink layer is diffused through the dye-diffusion preventive layer via the softening transfer-material which has been softened, so that the dye may be able to dye the softening transfer-material and dye acceptor particles. Thereupon, the softening transfer-material which has been lowered in viscosity adheres to the image receiving medium. When, in that condition, the thermal transfer sheet is peeled off the image receiving medium, at least the softening transfer-material and some dye acceptor particles, which have been dyed, are transferred onto the image receiving medium to provide a recorded image.

In other words, above a temperature at which the viscosity of the softening transfer-material is lowered, the dye is allowed to pass through the dye-diffusion preventive layer according to the quantity of heat applied, it being thus possible to control the dye uptake of not only the softening transfer-material but also of dye acceptor particles and to effect continuous gradation recording. Therefore, it becomes possible to form a high quality image of satisfactory gradation on an image receiving medium having no dye acceptor layer simply by controlling the quantity of heat energy according to an image signal.

When the thermal transfer sheet is stored at a temperature below the transition point of the softening transfer-material, diffusion of the dye is inhibited by the dye-diffusion preventive layer, so that the thermal transfer sheet is long stored safely with its initial recording characteristics preserved and without the particle-transfer layer being dyed.

In the thermal transfer sheet of the invention, the softening transfer-material preferably comprises at least a material having the melting point, such as wax or polyethylene glycol. This permits an abrupt change in the viscosity of the softening transfer-material between a heated portion and an unheated portion, so that the heated particle-transfer layer is easily separated from the thermal transfer sheet in the direction of thickness thereof, it being thus possible to achieve stable transfer image recording. Moreover, the resulting decrease in viscosity is so great that greater penetration of the softening transfer material into the dye-diffusion preventive layer may occur to improve recording sensitivity.

According to the invention there is also provided a method for production of a thermal transfer sheet, which comprises forming an ink layer containing a dye on a heat resistant sheet-form substrate, then applying on the ink layer an aqueous solution containing an aqueous material, followed by drying at a temperature higher than room temperature but lower than the transition point of the dye to thereby form a dye-diffusion preventive layer, and then applying on the surface of the dye-diffusion preventive layer an aqueous dispersion prepared by dispersing in water a softening transfer-material whose viscosity will be lowered by heating and dye acceptor particles of a dyeable thermoplastic resin material, followed by drying at a temperature higher than room temperatures but lower than the lowest transition point among those of the dye, the dye-diffusion preventive layer, the softening transfer-material and the dye acceptor particles to thereby form a particle-transfer layer.

According to the above described method, when the dye-diffusion preventive layer is formed, the drying process is carried out at a temperature below the transition point of the dye. Therefore, the dye in the ink layer will not undergo any phase transition that may lead to active diffusion in the drying process, it being thus possible to provide a dye-diffusion preventive layer free of dye inclusion. For the purpose of forming the particle-transfer layer, the drying process is carried out at a temperature below the lowest transition point among those of the dye, the dye-diffusion preventive layer, the softening transfer-material and the dye acceptor particles, and this eliminates the possibility of the dye to pass through the dye-diffusion preventive layer. Thus it is possible to provide an undyed particle-transfer layer.

Preferably, at least a particle-transfer layer is formed separately on a releasable base and transferred and laminated on a dye-diffusion preventive layer while it is formed. This is advantageous in that strict temperature control required during drying process can be completed in one operation, which provides for ease of manufacturing operation. Further, for the purpose of forming the particle-transfer layer, drying may be effected at higher temperatures. This enables formation of uniform layers, resulting in improvement in the quality of recorded image.

It is to be noted that the term "transition temperature" used herein refers to a temperature range higher than room temperatures in which a material is subject to phase transition. More specifically, the term means, in the case of dyes, melting point or sublimation point, and in the case of aqueous materials and polymeric materials, such as thermoplastic resins, the melting point, softening point or glass transition point.

Further, according to the invention there is provided a thermal transfer recording method using a thermal transfer sheet having the above described constitution, that is, a thermal transfer sheet having in this order a heat resistant sheet-form substrate, an ink layer containing a dye, a dye-diffusion preventive layer formed of an aqueous material, and a particle-transfer layer comprising at least a softening transfer-material whose viscosity will be lowered by heating, and dye acceptor particles of a dyeable thermoplastic resin material dispersed in the softening transfer-material, and wherein when the thermal transfer sheet and an image receiving medium, placed in superposed relation, are selectively heated according to an image signal, heating control is effected in such a way that an unheated portion around the heated portion according to the image signal in the particle-transfer layer may be transferred onto the image receiving medium.

According to the above method, even when only one picture element is provided as an image data, a part of particle-transfer layer that remain almost undyed is transferred together with a part of particle-transfer layer dyed according to the image data. If heating be effected exactly according to the image signal, such a portion as only one picture element is present for image transfer would be a cause of unsatisfactory transfer if the image receiving medium used lacks surface flatness, which results in image quality degradation. Even if image transfer could be effected at all, a transfer of one picture element or so would give no sufficient fixing power, and this would lead to a problem such that the trouble of peeling might occur during the use of the recorded matter. According to the recording method of the invention, however, as already stated, heating is controlled so that a boundary portion between a non-heated portion and a heated portion in the particle-transfer layer is actually transferred according to an image signal. Therefore, even where an image receiving medium having insufficient surface flatness is used, the method permits easy transfer and sufficient fixation.

DESCRIPTION OF THE PREFERRED EMBODIMENTS

FIG. 1 illustrates a schematic sectional view of a thermal transfer sheet representing one embodiment of the present invention. In FIG. 1, the reference number 1 designates thermal transfer sheet. The reference number 2 designates a heat resistant sheet-form substrate capable of withstanding the heat applied during recording operation. The reference number 3 designates an ink layer 3 composed of a dye and a binder material.

The reference number 4 designates dye acceptor particles of a thermoplastic resin dyeable with the dye contained in the ink layer 3. The reference number 5 designates a softening transfer-material which serves to carry dye acceptor particles 4 therewith and which is solid at room temperatures but is subject to a decrease in viscosity under heat. The reference number 6 designates a particle-transfer layer formed of the dye acceptor particles 4 disperse in the softening transfer-material 5.

The reference number 7 designates a dye-diffusion preventive layer of an aqueous material formed between the ink layer 3 and the particle-transfer layer 6.

The performance characteristics of the thermal transfer sheet 1 of the foregoing constitution as found for use in thermal transfer recording will be described hereinbelow. The procedure for recording is same as that used in the conventional thermal transfer recording practice. Initially, the surface of the particle-transfer layer 6 of the thermal transfer sheet 1 is pressed against an ordinary type image-receiving medium, such as pulp-based paper, which has no dye acceptor layer, and heating is effected by a thermal head from the sheet-form substrate 2 side according to a signal from the signaling source.

As a consequence of the heating, the softening transfer-material 5 is first made less viscous so that it penetrates into the dye-diffusion preventive layer 7, and the dye in the ink layer 3 is allowed to pass through the dye-diffusion preventive layer 7 via the softening transfer-material 5 which has been rendered less viscous, for thermal diffusion toward the particle-transfer layer 6. At the same time, the softening transfer-material 5 rendered less viscous is brought into contact with the image receiving medium to produce transfer power. As a result, a force is produced which urges transfer of the particle-transfer layer 6 containing dye acceptor particles 4 onto the image receiving medium. Thus, when the thermal transfer sheet 1 is peeled off the image receiving medium, at least some of the dye acceptor particles 6 which have been dyed according to the quantity of heat applied, are transferred together with the softening transfer-material 5 which has been softened by heating, whereby a recorded image is given.

In this way, the thermal transfer sheet of the invention can be used for image recording according to the conventional thermal transfer recording procedure, it being thus possible to achieve satisfactory image recording with satisfactory gradation such that dye acceptor particles 4, dyed according to the quantity of heat applied, and softening transfer-material 5 have been effectively transferred onto the image receiving medium, even if the image receiving medium has no dye acceptor layer.

The dye-diffusion preventive layer 7 of an aqueous material present between the ink layer 3 and the particle-transfer layer 6 essentially prevents the diffusion of the dye into particle-transfer layer 6 during the storage of the sheet at room temperatures at which the softening transfer-material 5 is not subject to any decrease in its viscosity. Therefore, dye acceptor particles 4 are not liable to becoming dyed with the dye and this permits satisfactory tone image recording even after long-term storage of the thermal transfer sheet 1.

Further, the softening transfer-material 5 and dye acceptor particles will not be transferred onto the image receiving medium unless heated; therefore, any portion of the image receiving medium which remains unprinted retains its inherent characteristics and permits writing.

It may be conceivable to use, instead of the particle-transfer layer 6, a uniform transfer layer in which component materials of the softening transfer-material 5 and dye acceptor particles are completely compatibilized. In this case, however, the problem is that mechanical strength of the transfer layer, when heated, is so strong that during thermal transfer recording the separation of the transfer layer is rendered unstable and unnecessary transfer of an unheated portion is likely to occur, with the result that any good quality transfer-recorded image can hardly be obtained.

However, attention must be drawn to the fact that according to the invention, the softening transfer-material 5 which contributes toward image transfer as its viscosity is lowered by heating, and dye acceptor particles 4 which contribute in particular to long stabilized dyeing, are contained in the particle-transfer layer 6 in a mixed state but are individually present therein when microscopically viewed. Therefore, when heated, the softening transfer-material 5 is easily separated between a heated portion and an unheated portion, as compared with the case where component materials are uniformly mixed together, it being thus possible to obtain a high-quality transfer recorded image.

For the sheet-form substrate 2, heat resistant resin films, such as polyethylene terephthalates and polyimides, or condenser paper may be used. It is noted that a surface portion of the substrate on which the ink layer 3 is not formed, that is, a surface portion with which the thermal head is brought into contact, may be subjected to a heat resistant treatment. For example, such surface portion may be provided with a heat resistant lubricating layer such that silicone, silicone oil, silica or the like is dispersed in a heat resistant resin material, such as thermosetting resin, U V-setting resins, or fluoroplastics. Further an adhesive layer formed of, for example, a saturated polyester resin may be provided between the ink layer 3 and the sheet-form substrate 2.

The thermoplastic resin which constitutes dye acceptor particles 4 is not particularly limited so far as it is dyeable with the dye contained in the ink layer 3. Examples of the thermoplastic resin include polyesters, vinyl chloride resins, vinyl chloride - vinyl acetate copolymer resins, ethylene - vinyl acetate copolymer resins, vinyl acetate resins, urethane resins, and butyral resins, used alone or in the form of a mixture thereof. Such thermoplastic resins used in the form of dye acceptor particles 4 should preferably be of the readily softening type in consideration of the adhesivity of particles the image receiving medium in the case of applied heat-energy being relatively low. So, it is preferred that a resin having a glass transition point of, for example, not more than 100° C. is used.

Dye acceptor particles 4 may be formed of the above mentioned thermoplastic resin alone, but in order to enhance their softening properties during heating, a plasticizer, such as dimethyl phthalate, oil, or paraffin, may be added to the thermoplastic resin if required. In order to avoid adhesion during storage of the thermal transfer sheet 1, fine particles of silica, talc or the like, or surface active agents may be added.

In FIG. 1, dye acceptor particles 4 are shown as particles having a generally uniform particle diameter, but they may be different in particle size, provided that the maximum particle diameter of the particles is preferably not more than 50 μm. If the maximum particle diameter is greater than 50 μm, in the case of a recording density of, for example, 10 dots/mm, only a few particles are present within a picture element of 100 μm × 100 μm, and accordingly one picture element may be visually seen as being divided into several colored dots, which means considerable degradation in image quality. As the particle size becomes greater, the degree of dye reception of particles will more widely differ between the case where particle centers are disposed in a central location of a heated portion at which the temperature increase is greatest and the case where particle edges are disposed in such a location. Such a difference is often a cause of density unevenness. Therefore, the maximum particle size is preferably not more than 50 μm. In this case, when the particle size distribution of particles is considered, a median particle diameter will be not more than about 30 μm. The terra "median diameter" used herein means a particle diameter such that an integrated weight of larger diameter particles is 50% of the total particle weight.

The shape of dye acceptor particles 4 are most preferably spherical in order to facilitate their good dispersion, but may have various other forms, such as polygon and scale.

The resin material used for dye acceptor particles 4 should be of such color as will not make the color of the dye cloudy, for example, light yellow, white or of the like color. When lamination of pigments is considered, a resin material having a high degree of transparency is preferred, and most preferably it is of crystal clear transparency.

Dye acceptor particles 4 are included for enabling diffused dye to be long preserved and are intended to improve keeping quality of recorded images. If image transfer is effected without such particle inclusion, that is, with the softening transfer-material 5 alone, the dye would separate out and agglomerate while the image is kept in storage, resulting in image quality degradation. Therefore, it is preferable that the proportion of the dye acceptor particles 4 is not less than 20 parts by weight on the basis of 100 parts by weight of the entire particle-transfer layer 6.

The ink layer 3 comprises a dye which is subject to thermal diffusion when heated, and a binder material. For the dye component, various different dyes may be used including, for example, oil-soluble dyes, disperse dyes, and sublimation-type dyes, provided, however, that the transition point of the dye should be higher than room temperatures. The reason is that since thermal diffusion of a dye becomes active at temperatures above transition point, the room temperature must be lower than the transition point of the dye in order that thermal diffusion of the dye may be sufficiently prevented at the room temperature. It is noted that the term "transition point" used herein refers to melting point or sublimation point. It is preferable that dyes having a transition point of not lower than 80° C. are selected for use to ensure sufficient shelf stability at room temperatures.

For the binder component of the ink layer 3, resin materials having high dye supporting ability should be used. Such resin materials include, for example, thermosetting resins, such as unsaturated polyesters and epoxy resins, and in addition to the aforementioned thermoplastic resins, acrylonitrile - styrene copolymer resins and acrylonitrile - butadiene - styrene copolymer resins, which may be used alone or in mixture. In particular, highly heat-resistant resins are preferred which will not be liable to decrease abruptly in viscosity at temperatures at which the softening transfer-material 5 is softened. The binder component may include, in addition such resin materials, various surface active agents, such as polyoxyethylene alkyl ether and fatty acid salts, and various powder materials, such as silica and kaolin, for purposes of improving dye dispersibility.

In order to facilitate the transfer of at least dye acceptor particles 4 and softening transfer-material 5 to the image receiving medium, it is desired that easy separation can occur at least between the particle-transfer layer 6 and the dye-diffusion preventive layer 7, or between the dye-diffusion preventive layer 7 and the ink layer 3. Therefore, it is desired that at least at one of these interfaces, no fusion adhesion will occur at room temperatures. In other words, it is desirable that the materials of dye acceptor particles 4 and softening transfer-material 5 and the material of the dye-diffusion preventive layer 7, or the material of the dye-diffusion preventive layer 7 and the material of the binder component of the ink layer 3, be incompatible with each other.

It is possible to use a conventional thermal transfer sheet of sublimation type and form on the surface of the ink layer 3 of this thermal transfer sheet a dye-diffusion preventive layer 7 and a particle-transfer layer 6 to thereby produce a thermal transfer sheet 1 of the present invention. In this case, no particular coating for forming an ink layer is required for preparing the thermal transfer sheet 1. It is only required that additional processing be applied to the surface of a commercially available thermal transfer sheet of sublimation type when needed, whereby a thermal transfer sheet 1 of the invention can be obtained. This permits production of the thermal transfer sheet 1 at a relatively low cost. It is noted in this conjunction that commercially available thermal transfer sheets are generally such that the ink layer of the sheet is lipophilic and, therefore, that at least the dye-diffusion preventive layer 7 should be hydrophilic.

For the softening transfer-material 5, aqueous materials and/or waxes are selectively used alone or in mixture. A wax is an organic material having a melting point of higher than room temperature. Waxes useful in the practice of the present invention include, for example, paraffins, microcrystalline wax, carnauba wax, candelilla wax, castor wax, rice wax, montan wax, montanic acid wax, oxidized wax, montan ester wax, partially saponified montan wax, Fischer Tropsch wax, beeswax, ceresin, fischer tropsche wax, ceresin wax, 12-hydroxystearic acid, derivatives of 12-hydroxystearic acid, amides of fatty acid, polyethylene wax, ester of glycerine and fatty acid, ester of glycol and fatty acid, ester of sorbitan and fatty acid, ester of polyoxyethylene and fatty acid, stearic acid, and palmitic acid.

Examples of useful aqueous materials include, for example, hydroxypropyl cellulose, polyethylene glycol (polyethylene oxide), polyvinyl pyrrolidone, hydroxyethyl cellulose, carboxymethyl cellulose, hydroxypropylmethyl cellulose, methyl cellulose, sodium alginate, aliginate of propylene glycol, gum arabic, collagen, sodium polyacrylate, polyacrylamide, aqueous acrylic resins, aqueous alkyd resins, aqueous polyesters, sodium polystyrene sulfonate, polyvinyl alcohol, starch, agar-agar, glue, guar gum, carrageenan, and gelatin.

Further, in order to facilitate the formation of particle-transfer layer 6, thermoplastic resins having a low melting point or softening point, such as rosin, ketones, acrylic resins, vinyl acetate resins, acryl - vinyl acetate copolymer resins, hydrocarbon resins, and maleic acid resins, may be suitably included into the softening transfer-material 5. Also, in order to optimize the viscosity of the softening transfer-material at the time of viscosity decrease and/or the coatability during the process of sheet fabrication, surface active agents, such as polyoxyethylene nonylphenyl ether, sorbitan monostearate, and polyoxyethylene lanolin alcohol ether, plasticizers, such as dibutyl phthalate, dicyclohexyl phthalate, and liquid paraffin, fine particles such as of calcium carbonate and talc and/or various kinds of antiseptic and mildewproofing agents, may be suitably included.

For the softening transfer-material 5, it is desirable to use a material having high permeability to the dye-diffusion preventive layer 7 and liable to considerably decrease in its viscosity under heat to the extend that transfer and non-transfer of softening transfer-material 5 can be clearly defined at the boundary of heated and non-heated portions, or more particularly, a material having a melting point, such as wax or polyethylene glycol, as earlier referred to..

Where any of the earlier enumerated waxes is used as at least a part of the softening transfer-material 5, the wax should preferably have an acid value of not more than 20. The reason for this will be explained below. The greater the acid value, the greater is the proportion of free aliphatic acid of low molecular weight. This encourages free aliphatic acids of low molecular weight to migrate within the softening transfer-material 5 at room temperatures. Even after transfer has been effected, therefore, free aliphatic acids are likely to move and accordingly dye particles which, in addition to dye acceptor particles 4, are dispersed in the wax mass begin to agglomerate. This results in degradation of the density of recorded image and the chroma of color. This phenomenon becomes pronounced when the acid value exceeds 20, which leads to serious deterioration of the keeping quality of recorded images. Therefore, the use of a wax having an acid value of not more than 20 is especially preferred. In consideration of long-term storage, it is preferred that the acid value should be made as low as possible, preferably at a level of not more than 15.

Where wax is used as a principal ingredient of the softening transfer-material 5, it is desirable to add an aqueous material, such as polyvinyl alcohol, which has good film forming property, because wax is poor in its ability to support dye acceptor particles 4 as well as in its film forming ability. Especially aqueous cellulose such as methyl cellulose and hydroxyethyl cellulose gives good thickening effect in a small quantity. Accordingly the aqueous cellulose also acts as a dispersant. Further, such aqueous cellulose exhibits excellent thermal stability because no transition point is present within a temperature range of up to a heat decomposition point of 200° C. or above. Therefore, the use of such aqueous cellulose is especially preferred.

Where polyethylene glycol is used as a principal ingredient of the softening transfer-material 5, a relatively large decrease in viscosity will occur when the softening transfer-material becomes softened, and this will result in satisfactory image transfer onto plain paper. Further, recording sensitivity can be improved when an organic acid salt, such as sodium stearate, sodium palmitiate, or sodium myristate, is added. Such addition is particularly preferred. This may be explained by the fact that the organic acid salt is dissolved in a melt of the polyethylene glycol to give an alkaline melt which has greater permeability to the dye-diffusion preventive layer 7 formed of an aqueous material.

The thickness hl of the layer comprised of the softening transfer-material 5 alone (see FIG. 1) is preferably not less than 0.5 μm but not more than 50 μm. If the thickness is less than 0.5 μm, no sufficient strength to support dye acceptor particles 4 could be obtained, so that image preservation would be practically impossible. As the thickness of the layer becomes greater, more thermal energy is required to soften the softening transfer-material, which results in lowered recording sensitivity. If the thickness exceeds 50 μm in particular, too much thermal energy is required and, as a result, in the case where the heat resistant sheet-form substrate 2 is formed of polyethylene terephthalate which is inexpensive, it begins to become softened by the thermal energy, resulting in rupture of the thermal transfer sheet under a tension applied during transport thereof. Therefore, in order to ensure that polyethylene terephthalate can be used as the material for the sheet-form substrate in the fabrication of an inexpensive thermal transfer sheet 1, it is desirable that the thickness h1 of the layer comprised of the softening transfer-material is not more than 50 μm. More specifically, a thickness of not more than 30 μm is preferred.

For the dye-diffusion preventive layer 7, the earlier mentioned aqueous material, which is less compatible and less dyeable with dyes at room temperatures, is used in order to prevent diffusion of the dye at least at room temperatures.

The aqueous material of which the dye-diffusion preventive layer 7 is formed should have a transition point higher than room temperatures. The reason for this is that since thermal diffusion of a dye within a resin material is encouraged at temperatures above the transition point of the resin, the room temperature must be lower than the transition point in order that dye diffusion at room temperature may be satisfactorily prevented. It is to be noted that the term "transition point" herein used means glass transition point, melting point or softening point. In consideration of satisfactory storage life at room temperature, it is recommended that aforesaid aqueous material having a transition point of not less than 50° C. or a resin material of low polarity is selected as the material for the dye-diffusion preventive layer 7. Among aqueous materials, polyvinyl alcohol has good film-forming characteristics and, in addition, it has an advantage that its glass transition point is 70° C. or higher. The polyvinyl alcohol is particularly preferred for use as the constituent material of the dye-diffusion preventive layer 7.

Therefore, as a preferred embodiment, the thermal transfer sheet 1 of the invention comprises a heat resistant sheet-form substrate 2, an ink layer 3 containing a dye laminated thereon, a dye-diffusion preventive layer 7 formed of polyvinyl alcohol and laminated on the ink layer 3, and a particle-transfer layer 6 laminated on the dye-diffusion preventive layer 7, the particle-transfer layer 6 comprising a softening transfer-material 5 composed essentially of an aqueous material and wax, and dye acceptor particles 4 of a dyeable thermoplastic material dispersed in the softening transfer-material 5. This constitution provides good storage properties and is particularly preferred.

While dye diffusion can be sufficiently prevented by increasing the thickness of the dye-diffusion preventive layer 7, it is possible to use an aqueous material which can be crosslinked. Dye diffusion paths are generally considered to be intermolecular gaps. Therefore, by causing molecules to be bonded together tridimensionally by crosslinking, it is possible to enable the dye diffusion layer to sufficiently prevent dye diffusion, even if the layer is relatively thin. However, where crosslinking requires heating at elevated temperatures, such crosslinking is undesirable because dye particles will become diffused before the layer is formed. For the purpose of crosslinking, therefore, a resin material which can be crosslinked in a low temperature range between room temperature and about 50° C., for example, glyoxal or methylated melamine resin, should be used. In particular, glyoxal is preferred because it can be crosslinked at room temperatures.

At same time, however, since a dye-diffusion preventive layer 7 composed of glyoxal acts strongly to prevent the penetration of the softening transfer-material 5 even when the transfer material 5 has become less viscous, it is desirable to use, for the softening transfer-material 5, a mixture of aqueous material and an organic acid salt, which displays exceedingly high penetrating power at its lowered viscosity state. It is preferred that polyethyleneglycol, which viscocity will decrease largely over a melting point, is utilized for aqueous material.

In order that image transfer may be smoothly effected without density jump, it is desirable that there should be a region for transfer of a softening transfer-material 5 which remains almost undyed and dye acceptor particles 4, when applied energy is low. For this reason, it is desirable that the melting point or softening point of the softening transfer-material 5 is not more than the transition point of the aqueous material. Further, in view of the fact that thermal transfer sheets 1 are, more often than not, stored in coiled condition, care should be taken to ensure that sheets 1 will not adhere to one another. Therefore the softening transfer-material 5 has transition point, that is, melting temperature or softening temperature, higher than room temperature. In conclusion, the melting point or softening point of the softening transfer-material 5 is preferably same as or lower than the transition point of the aqueous material but higher than room temperature, in particular 50° C. or more.

The thickness of the dye-diffusion preventive layer 7 is preferably 0.5 μm or more. If the thickness is less than 0.5 μm, holes may sometimes be formed in the dye-diffusion preventive layer 7 in the process of the layer formation, so that the layer 7 may not sufficiently prevent dye diffusion. Preferably, the thickness is 1 μm or more. It is to be noted, however, that if the dye-diffusion preventive layer 7 is excessively thick, the softening transfer-material 5 can hardly reach the ink layer 3 when softened for penetration, so that diffusion of dye toward the particle-transfer layer 6 is made difficult, resulting in considerable decrease in recording sensitivity. Therefore, the thickness of the dye-diffusion preventive layer 7 should be not more than 20 μm, preferably not more than 15 μm.

In the drawing, the dye-diffusion preventive layer 7 is illustrated as a single layer; but of course it may be constructed as plural layers of different materials.

In the fabrication of a thermal transfer sheet 1, various kinds of organic solvents, including, for example, water, alcohol, octane, acetone and toluene, may be used alone or in mixture in the process of forming an ink layer 3, a dye-diffusion preventive layer 7 and a particle-transfer layer 6. However, when the dye-diffusion preventive layer 7 and particle-transfer layer 6 are formed, it is required that a solvent which will not affect the ink layer 3 is used so as not to cause diffusion of dye present in the ink layer 3. For example, where the ink layer 3 is formed from a lipophilic resin, water is most preferred. Therefore, when the aqueous material or softening transfer-material 5 is insoluble in water, it is desirable to use dispersions or the like in which respective materials are minutely dispersed.

A preferred method for preparing a thermal transfer sheet is as follows. A dye is dissolved or dispersed in a solution in which a binder material is dissolved. The resulting solution or dispersion is applied on a sheet-form substrate 2, the coating being then allowed to dry. An ink layer 3 is thus formed. An aqueous solution prepared by dissolving an aqueous material in water is applied on the ink layer 3 and the coating is dried at a temperature higher than room temperature but lower than the transition point of the dye, whereby a dye-diffusion preventive layer 7 is formed. An aqueous dispersion prepared by dispersing or partially dissolving the softening transfer-material 5 and dye acceptor particles 4 in water is applied on the surface of the dye-diffusion preventive layer 7, and then the coating is dried at a temperature higher than room temperature but lower than the lowest transition points among those of the dye, dye-diffusion preventive layer, softening transfer-material and dye acceptor particles, whereby a particle-transfer layer 6 is formed.

In this way, drying temperatures are strictly controlled in the process of forming the dye-diffusion preventive layer 7 and particle-transfer layer 6. In the process of forming the dye-diffusion preventive layer 7, drying must be effected at a temperature lower than the transition point, that is, melting point or sublimation point, of the dye. The reason for this is that drying at a temperature above the transition point of the dye may cause inclusion of dye into the coating in the course of being dried. The inclusion may permit easy diffusion of the dye. As a result, stable recording at low density is made impracticable and it becomes difficult to preserve the sheet.

Similarly, during the process of forming particle-transfer layer 6, drying must be effected at a temperature lower than the lowest of the transition points (melting points, sublimation points, softening points, or glass transition points) among those of the dye, dye-diffusion preventive layer, softening transfer-material and dye acceptor particles. For example, if the softening transfer-material and dye acceptor particles in the coating are dried at a temperature above the transition point thereof, those materials which have thus been rendered less viscous will penetrate into the dye-diffusion preventive layer 7, thus dye diffusion being encouraged. At temperatures above the transition point of the dye-diffusion preventive layer 7, a relatively large amount of its ingredient will melt into the coating and, as a consequence, the dye-diffusion preventive layer 7 cannot be formed between the ink layer 3 and the particle-transfer layer 6. Therefore, the resulting sheet is extremely unfavorable in its storage characteristics.

Figure 2:
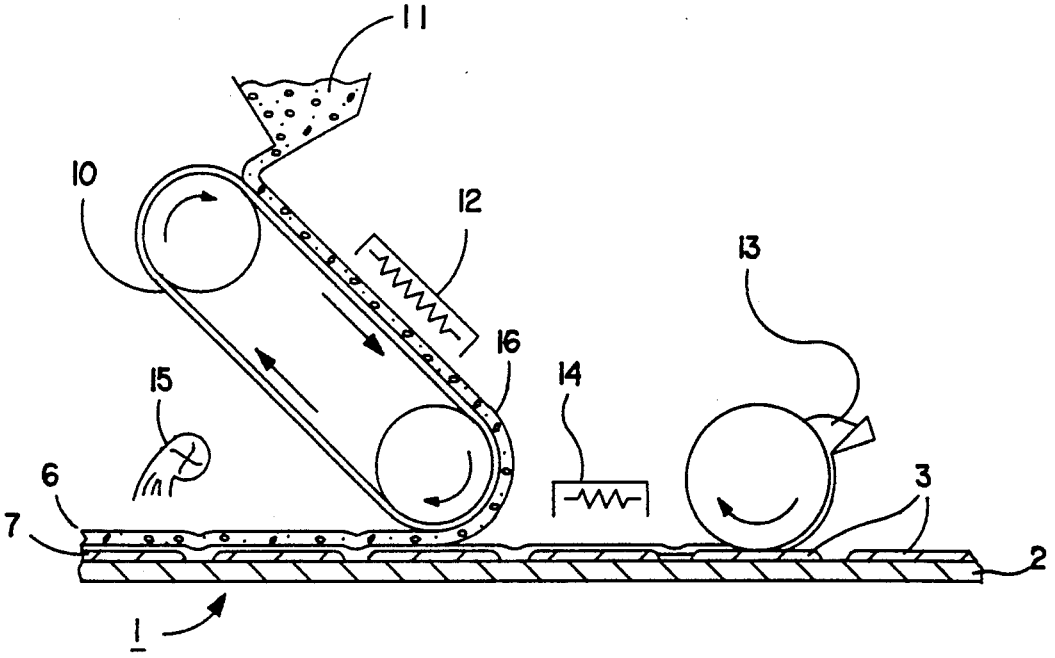
FIG. 2 is a schematic view of an example of apparatus for producing a thermal transfer sheet of the present invention.
Figure 3A:
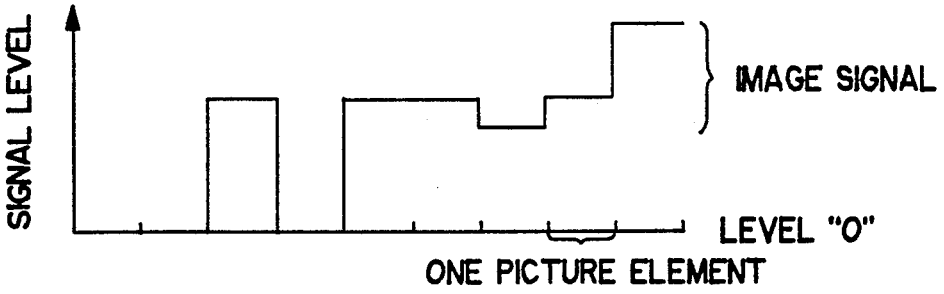
FIGS. 3*a*–3*d* are to explain a method of thermal transfer recording in the use of the thermal transfer sheet of the present invention.
Figure 3B:
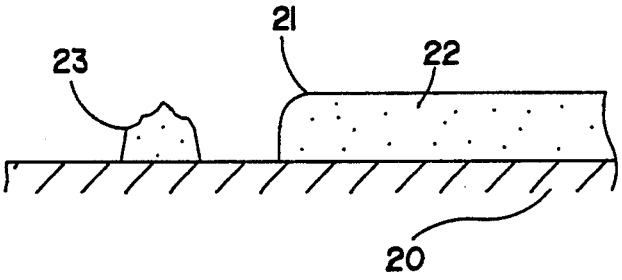
Figure 3C:
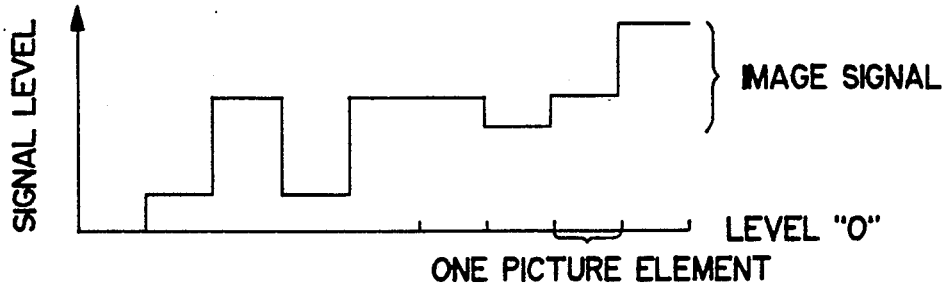
Figure 3D:
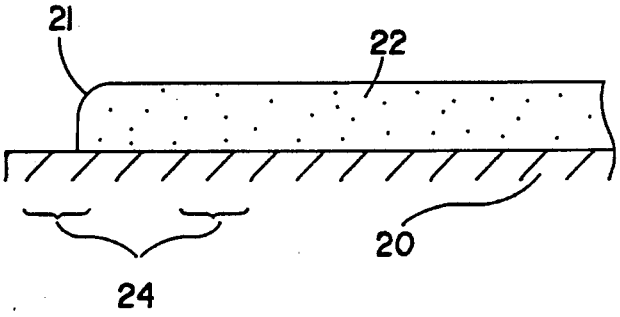

The production of the thermal transfer sheet may be carried out by employing a coating apparatus of, for example, such a type as illustrated in FIG. 2. First, a dye containing ink layer 3 is formed on a heat resistant sheet-form substrate 2 according to the conventional printing procedure. A coating dispersion for a particle-transfer layer 11 which contains at least a softening transfer-material 5 whose viscosity decreases by heating and dye acceptor particles 4 of a dyeable thermoplastic material is applied on a releasable substrate 10 and the coating is dried by a dryer 12. A particle-transfer layer 6 is thus temporarily formed on the releasable substrate 10. No strict temperature control is required in this stage so far as the particles transfer layer is formed with the dye acceptor particles dispersed therein.

A coating solution for dye-diffusion preventing layer 13, which is an aqueous solution containing an aqueous material, is applied on the ink layer 3, and then the surface of the coating is slightly dried in a supplementary dryer 14 to such an extent that the surface remains sticky (that is, being not completely dried). In this state, the particle-transfer layer 6 on the releasable substrate 10 is pressed against the sticky surface and the releasable substrate 10 is peeled off. In this way, the dye-diffusion preventive layer 7 and the particle-transfer layer 6 are laminated on the ink layer. Finally, the resultant sheet is completely dried by a cool-air blower 15. The drying must, of course, be effected at a temperature lower than the lowest transition points (that is, melting points, sublimation points, softening points or glass transition points) among those of the dye, dye-diffusion preventive layer, softening transfer material, and dye acceptor particles.

In the above production method, the aqueous material for the dye-diffusion preventive layer 7 is applied on the ink layer 3. Alternatively, it may be applied on the particle-transfer layer 6 formed on the releasable substrate 10.

In the coating method illustrated in FIG. 2, sufficient heating can be effected during the formation process of particle-transfer layer 6, which permits easy formation of a uniform dispersion film with the least thickness irregularity. This provides for smooth contact between the particle-transfer layer 6 and the surface of image receiving medium and thus contributes much toward improvement of image quality. The above described method is especially preferred as a method for production of thermal transfer sheet 1.

The coating method applicable is not limited to the one illustrated in FIG. 2. The particle-transfer layer 6 can also be formed on the dye-diffusion preventive layer 7 according to the curtain-coating method which is conventionally employed.

A thermal transfer recording method using the thermal transfer sheet 1 of the invention will now be described with reference to FIG. 3. FIG. 3 (*a*) illustrates an example of image signal wherein image signal is partially not given (e.g., in the case of ruled line or the like). The illustration relates to monocolor recording, but it is noted that the following description equally applies to other color recording, such as cyan, magenta and yellow.

FIG. 3 (*b*) illustrates a typical case in which conventional thermal transfer recording is made by using thermal transfer sheet 1 according to image signals. In the right half portion of the drawing in which image signals continue in succession, at least softening transfer-material 5 and dye acceptor particles 4 are transferred onto the image receiving medium to form a satisfactory dyed layer 21. As the amount of transferred dye 22 varies according to the level of image signal, images with gradation are formed. The dyed layer 21 consists at least of a mixture of dye acceptor particles and softening transfer-material 5, and in the drawing it is shown as a uniform layer. However, at a site at which an image signal of one picture element only is isolated, a transfer defect may occur due to uneven contact as shown in the left half portion of the drawing. When such a transfer contact leads to considerable degradation in image quality.

Therefore, by effecting heating control so that the particle-transfer layer 6 may be transferred with respect to a single or plural picture elements at which an image signal is discontinued, as shown in FIG. 3 (*c*), satisfactory transfer can be effected at least at positions where image signal level is present and, at the same time, a substantially undyed layer 24 can be formed around such positions. A recorded image of satisfactory quality is thus obtained. Such heating control can be effected by applying a heat energy of such a degree that will permit dye acceptor particles 4 and softening transfer-material 5 to start transfer behavior.

In FIG. 3, undyed layers 24, each of which corresponds to one picture element, are formed, but such a layer may be formed in accordance to two or more picture elements.

When an undyed layer 24 is formed as in FIG. 3, in full color recording the image quality will be considerably degraded if the layer has been dyed even a little. In view of such possibility, recording in yellow color, which color is most imperceptible, is first effected. At that time, for a position or positions where imperfect transfer is likely to occur in the case of multicolor transfer (magenta, cyan, etc.), an undyed layer are formed through heating control even if no yellow signal is issued. For colors other than yellow, only heating control is effected according to the image signal.

When full color recording is to be made by superposed color recording with respect to three primary colors of at least yellow, magenta and cyan, transfer is effected first with respect to yellow signals and heating control is made in such a way that a dyed layer 21 is formed over the entire image area even where no image signal is issued. For recording in colors other than yellow for superposition on the yellow color, only heating control may be effected according to the signal. In this case, since dyed layer 21 has already been formed, transfer from the particle-transfer layer 6 can be easily done and occurrence of any imperfect transfer site 23 can be avoided, it being thus possible to obtain a recorded image of good quality.

In the thermal transfer sheet 1 when at least a part of the softening transfer-material 5 becomes less viscous, it comes to penetrate into the dye-diffusion preventive layer 7 in the direction of thickness thereof to permit diffusion of the dye present in the ink layer 3, whereupon the amount of dye diffusion can be controlled according to the degree of heating. Therefore, the sheet should be stored at a temperature lower than the lowest transition points (melting or softening points) among those of the components of the softening transfer-material, preferably at a temperature lower by 10° C. or more than the lowest transition temperature.

The dye-diffusion preventive layer 7, which is composed of an aqueous material, is liable to be influenced by humidity. When humidity is high, the dye-diffusion preventive layer 7 absorbs moisture and its ability to prevent dye diffusion may be deteriorated. Therefore, it is desirable that the sheet is kept in dehumidified atmosphere.

Detailed examples with respect to thermal transfer sheets made as an experiment are given below. For the purpose of thermal transfer recording with the transfer sheets 1, a thermal head with a recording density of 6 dots/mm was employed and wood-free paper (paper surface density of 0.08) with a Beck smoothness of about 30 s was used as an image receiving medium. Heat recording (max. 9 J/cm$^2$) was made at vertical scanning rate of 33.3 ms/line with pulse-width controlled (maximal pulse width: 16 ms). For measurement of recording density was employed Macbeth densitometer RD 914.

As a sheet-form substrate 2 was used a biaxially oriented film of polyethylene terephthalate having a thickness of 7 μm, with a lubricating layer of UV resin of 1 μm thickness, formed on the surface to be brought into contact with the thermal head, and with an adhesive layer of saturated polyester resin of 0.2 μm thickness formed on the surface on which an ink layer 3 was to be formed.

An ink layer 3 of about 5 μm thickness was formed on the adhesive layer by applying a coating solution containing 20 parts by weight (referred to as "part(s)" hereinafter) of acrylonitrile-styrene resin (made by Denki Kagaku Kogyo K.K.; heat distortion temperature: 88°-95° C.) and 10 parts of cyan dye of indoaniline type (made by Mitsubishi Kasei Corp.; melting point: 128° C.) dissolved in toluene / 2-butanone (mixture ratio 1/1) solvent of 70 parts, followed by drying. In the below examples, various types of dye-diffusion preventive layer 7 and particle-transfer layer 6 are formed on the ink layer 3 to be studied in detail.

EXAMPLE 1

On the ink layer 3 was applied a 5% aqueous solution of hydroxyethyl cellulose (made by Daicel Chemical Industries, Ltd.; HEC Daicel SP 400) noncompatible with acrylonitrile - styrene resin. The coating was dried with warm-air at 60° C. and thus a dye-diffusion preventive layer 7 was formed. In this case, since hydroxyethyl cellulose has no transition point above room temperature, drying was effected with warm air at 60° C., sufficiently lower than the melting point of 128° C. of the cyan dye.

On the dye-diffusion preventive layer 7 was applied by a roll coater a solution containing of 20 parts of solid polyethylene glycol (made by Dai-ichi Kogyo Seiyaku Co., Ltd.; PEG No. 20000, average molecular weight: 20,000, melting point: 56°-62° C.), as softening transfer-material 5, 20 parts of dye acceptor particles 4 (median diameter: 10 μm, maximum particle diameter: 25 μm) of polyvinyl butyral (made by Sekisui Chemical Co., Ltd; Eslec BL-S; glass transition point: 55° C.), 80 parts of water, and 0.2 parts of a surface active agent (made by NOF Corp.), and the coating was dried with cool-air at 30° C. Thus, a particle-transfer layer 6 having an irregular surface (highest convex portion of more than 20 μm), in which the layer portion comprised of the softening transfer-material 5 had a mean thickness of about 7 μm, was formed. In this way, a thermal transfer sheet 1 was made as an experiment. In the process of forming this particle-transfer layer 6, the lowest glass transition point was that of polyvinyl butyral; 55° C., the cool-air drying process was carried out at 30° C.

Also, a different thermal transfer sheet was made in which no dye-diffusion preventive layer was formed and the same particle-transfer layer 6 as above said was formed directly on the surface of the ink layer 3.

Figure 4:
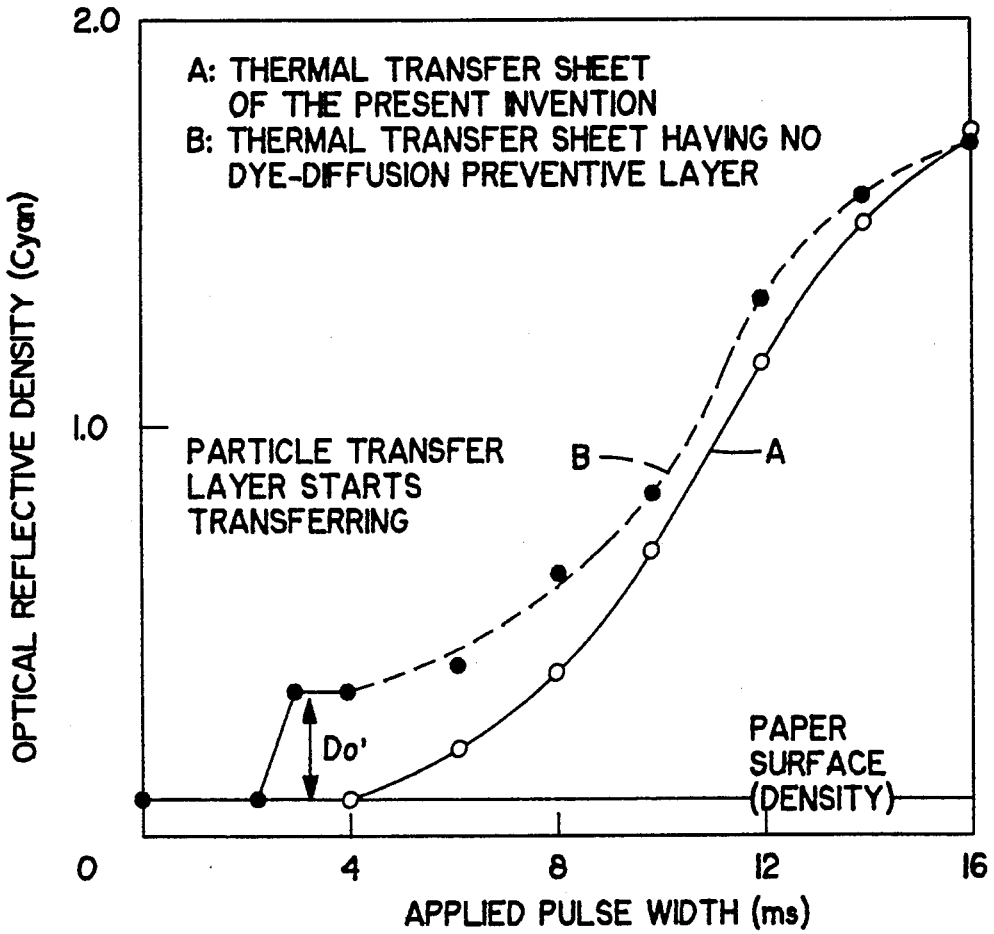
FIG. 4 is a graphic representation showing one example of recording characteristics after storage of the thermal transfer sheet of the invention.

Each thermal transfer sheet was allowed to stand at room temperature (25° C.) for one month and, thereafter, recording was effected according to the earlier described procedure. Recording characteristics are shown in FIG. 4. The abscissa axis represents pulse widths applied to the thermal head, and the ordinate axis represents optical reflective density for cyan color. Graph A represents recording characteristics of the thermal transfer sheet 1 of the invention; Graph B represents recording characteristics of the thermal transfer sheet having no dye-diffusion preventive layer 7. Prior to storage, both sheets had recording characteristics almost similar to those shown in graph A. When thermal transfer sheet 1 was used, density could be increased successively from the paper surface density because the particle-transfer layer 6 was substantially transparent. In contrast, as may be apparent from graph B, when the thermal transfer sheet having no dye-diffusion preventive layer 7 was used, dye acceptor particles had become dyed during storage and, therefore, at the time when transfer starts, the particle-transfer layer was already foggy (Do' about 0.26).

The dye-diffusion preventive layer 7 formed of hydroxyethyl cellulose prevented unnecessary transfer of dye toward the particle-transfer layer 6 during sheet storage at room temperature, with the result that satisfactory gradation characteristics could be achieved to the tone of maximum density of 1.7.

In the present example, methyl cellulose (made by Shin-Etsu Chemical Co., Ltd.; Metolose SM 4000; no transition point above room temperature); hydroxypropyl methyl cellulose (made by Shin-Etsu Chemical Co., Ltd.; Metolose 60 SH 4000; no transition point above room temperature); and polyvinyl alcohol (made by Kuraray Co., Ltd.; Kuraray Poval PVA-117; glass transition point: 70°-80° C.) were individually used in place of hydroxyethyl cellulose to give similar results.

In order to form a thinly dyed layer 21 at a boundary of image signals, as earlier described with reference to FIG. 3, by using a thermal transfer sheet 1 as specified in the present example, the width of pulses applied was set at 4 ms, whereby the desired layer formation could be achieved. This heating control also enabled satisfactory recording of line drawings, and there was no problem with fixation.

EXAMPLE 2

In a manner similar to Example 1, a 5% aqueous solution of polyvinyl alcohol (made by Kuraray Co., Ltd.; Kuraray Poval PVA-HC; glass transition point: 70°-80° C.) noncompatible with acrylonitrile-styrene resin was applied on the ink layer 3, followed by warm-air drying at 60° C. Dye-diffusion preventive layers 7 having different thickness within the range of 0.2 to 5 μm were thus formed. A suspension containing of 27 parts of castor wax (made by Kokuragosei Kogyo; melting point: 85° C.) which was to serve as softening transfer-material 5, 70 parts of water and 3 parts of anionic surface active agent (made by NOF Corp.; decomposition point: not less than 200° C.), was prepared. In this suspension was dispersed 20 parts of polyvinyl butyral (made by Sekisui Chemical Co., Ltd.; Eslec BL-S; glass transition point: 55° C.), which was to serve as dye acceptor particles 4 (median diameter, 5 μm; maximum diameter: about 10 μm). A coating solution for the particle-transfer layer 6 was thus prepared. The coating solution was applied on the surface of the dye-diffusion preventive layer 7, which coating was dried with cool-air at room temperature to give a particle-transfer layer 6 having an irregular surface, in which the softening transfer-material 5 had a layer thickness of about 15 μm. Thus a thermal transfer sheet 1 was obtained. The particle-transfer layer 6 becomes transparent after heated to be transferred.

Figure 5:
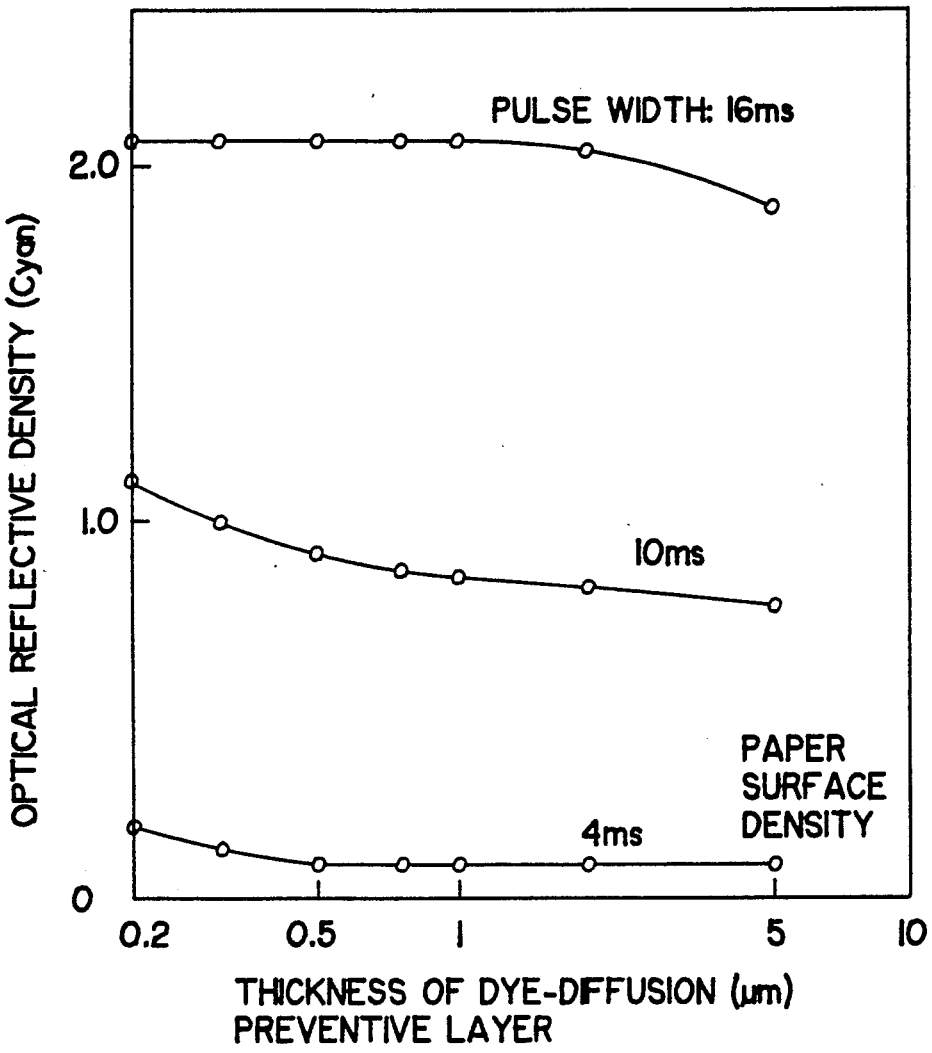
FIG. 5 is a graph showing one example of recording characteristics after storage of the thermal transfer sheet in relation to the thickness of the dye-diffusion preventive layer thereof.

FIG. 5 shows recording characteristics exhibited by thermal transfer sheets having different thicknesses which had been allowed to stand at room temperature for one month. The abscissa axis represents thickness of dye-diffusion preventive layer 7, and the ordinate axis shows optical reflective density with respect to cyan color. Pulse widths applied to the thermal head were shown as parameters. Transfer behavior of particle-transfer layer 6 was not uniform when the pulse width was 3 ms. Particle-transfer layer 6 showed uniform transfer behavior when the pulse width was 4 ms. This tells that the controllable range for uniform recording is 4 ms and higher, and that gradation recording can be effected successively from the paper surface density when the thickness of the dye-diffusion preventive layer 7 is not less than 0.5 μm. If the dye-diffusion preventive layer 7 was excessively thick (5 μm), the recording density was somewhat lowered, and the maximum density was also lowered. In these experiments the dye-diffusion preventive layer 7 was also transferred.

In other words, when the thermal transfer sheet 1 as specified in the present example is used, in order that a substantially undyed layer 24 may be formed on the surface of image receiving medium 20 as earlier described, it is desirable to effect heating control with the pulse width set at 4 ms according to the image signal at the boundary between a heated portion and a non-heated portion.

In the thermal transfer sheet 1 having the dye-diffusion preventive layer 7 of 1 μm thickness formed of polyvinyl alcohol, magenta dye of imidazole azo-type (made by Mitsubishi Kasei Corp.; melting point: 97° C.), and a yellow dye of dicyanostyryl-type (made by Mitsubishi Kasei Corp., melting point: 183° C.) were respectively used instead of the cyan dye dispersed in the ink layer 3 to give thermal transfer sheets 1. Recording was made by using the thermal transfer sheets 1, with the result that recording with gradation could be achieved to provide a successively gradated image in magenta color with maximum density of 1.92, and gradation recording in yellow color with maximum density of 1.85. A full-color image could be readily obtained by recording the three colors in superposed relation.

When stearic acid (with a melting point of about 72° C.), palmitic acid (with a melting point of about 64° C.), and carnauba wax (with a melting point of about 80°-86° C.) were respectively used in place of castor wax, images could be recorded similarly. Further, it was found that a wax having a lower melting point resulted in higher recording sensitivity and recording with less energy applied.

In the present example, warm-air drying temperature was varied during the process of forming 1 μm thick dye-diffusion preventive layer 7 of polyvinyl alcohol in preparation of thermal transfer sheets 1. The findings in this connection are noted hereinbelow. In the step of drying the polyvinyl alcohol coating, drying was effected at 90° C., a temperature higher than the glass transition point of polyvinyl alcohol, in one case, and at 135° C., a temperature higher than the melting point of cyan dye, in another case. The dye-diffusion preventive layer 7 formed through drying at 90° C. was dyed slightly in cyan color, while in the case of 135° C. drying, the dye was found to have been crystallized partially on the surface. When a particle-transfer layer 6 as specified hereinabove was formed on the layer dried at 90° C., initial transfer density was already 0.26 and recording of a lower density than this could not be done.

In the process of forming a particle-transfer layer 6 on a dye-diffusion preventive layer 7 formed through warm air drying at 60° C., drying was carried out at 90° C., a temperature higher than the melting point of castor wax. The result was that the surface of the sheet prepared was already dyed in cyan color and initial recording density was more than 0.54. Recording of a lower density than this could not be achieved. Therefore, it is indispensable to control drying temperature for each individual layer in the preparation of a thermal transfer sheet of the present invention.

EXAMPLE 3

In a manner similar to the foregoing examples, on the ink layer 3 prepared was formed a dye-diffusion preventive layer 7 having a thickness of about 1.0 μm by applying an aqueous solution containing in mixture, 20 parts of a 5% aqueous solution of polyvinyl alcohol (made by Kuraray Co., Ltd.; Kuraray Poval PVA-HC; glass transition point: 70°-80° C.) noncompatible with acrylonitrie-styrene resin and 0.2 parts of glyoxal solution (made by The Nippon Synthetic Chemical Industry Co., Ltd.; solid content: 40%), followed by drying and subjecting the coating to warm air drying for crosslinking polyvinyl alcohol.

On the dye-diffusion preventive layer 7 was applied a mixed solution containing 20 parts of solid polyethylene glycol (PEG#2000; made by Dai-Ichi Kogyo Seiyaku Co., Ltd.; average molecular weight: 20,000; melting point: 56°-62° C.) as softening transfer-material 5, 20 parts of particles (of 5 μm in median particle diameter and 10 μm in maximum particle diameter) of polyvinyl butyral (made by Sekisui Chemical Co., Ltd.; Eslec BL-S; glass transition point: 55° C.) as dye acceptor particles 4, 80 parts of water and 5 parts of sodium stearate (made by kanto Chemical Co., Inc.), followed by cool air drying at room temperature to form a particle-transfer layer 6 having a slightly irregular surface wherein the softening transfer-material 5 has a layer thickness of about 15 μm. A thermal transfer sheet 1 was thus prepared.

After the thermal transfer sheet 1 was allowed to stand at room temperature for a week, thermal transfer recording was carried out using the sheet according to the conventional procedure. In this recording, the dye-diffusion preventive layer remained untransferred and a tone of recorded image was obtained with a gradient of from paper surface density up to a maximum density of 1.35.

In the present example, experiments were also made by using methyl cellulose (made by Shin-Etsu Chemical Co., Ltd.; Metolose SM 4000) and hydroxypropyl methyl cellulose (made by Shin-Etsu Chemical Co., Ltd.; Metolose 60 SH 4000) respectively instead of polyvinyl alcohol, and further by forming an adhesive layer of 0.3 μm thickness formed of aqueous polyester (made by Toyobo Co., Ltd.; Vylon) between the ink layer 3 and the dye-diffusion preventive layer 7. In these cases, similar results were obtained too.

Also, recording was tried with a thermal transfer sheet 1 prepared by omitting sodium stearate in the present example. In this case, recording could be achieved with gradation, but the maximum density was lowered to 0.65. This tells that organic acid salt is a useful ingredient in the above described constitution.

Further, in the present example, experiment was made by using methylated melamine resin (made by Sumitomo Chemical Co., Ltd.; Sumimal) for crosslinking instead of glyoxal and it was found that methylated melamine resin was as effective as glyoxal in inhibiting dye diffusion. In this case, methylated melamine resin, when mixed with polyvinyl alcohol, would not permit uniform coating. Therefore after polyvinyl alcohol was applied and dried, an aqueous solution of methylated melamine resin was applied thereon and dried. Then the coating was heated to a temperature of about 50° C. to form a dye-diffusion preventive layer 7.

Further in the present example, particles (with a median diameter of 7 μm and a maximum diameter of about 15 μm) of vinyl chloride - vinyl acetate copolymer resin (made by Nissin Kagaku Kogyo K.K.; NISSIN MPR-TS 40; a mixture of vinyl chloride of 60 wt % with vinyl acetate of 40%) as dye acceptor particles 4 was used. In this case, after one-month storage of the resulting sheet, satisfactory recording could be made with gradation successively from surface density of 0.08 to a maximum density of 1.43. Only particle-transfer layer 6 was transferred for recording with the corresponding dye-diffusion preventive layer 7 having almost remained on the thermal transfer sheet 1.

EXAMPLE 4

Figure 6:
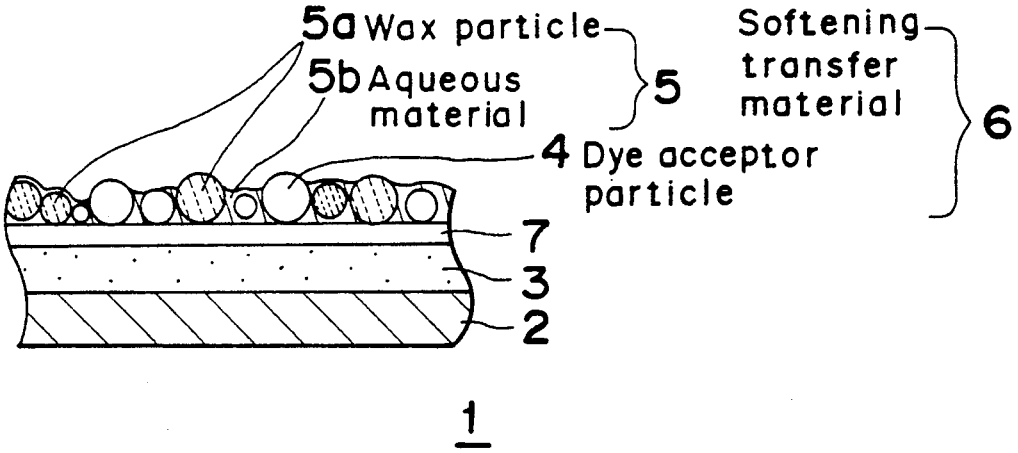
FIG. 6 is a schematic sectional view showing a thermal transfer sheet representing another embodiment of the present invention.

In this Example 4, the softening transfer-material 5 in the thermal transfer sheet 1 is composed of particulate wax particles 5*a* and an aqueous material 5*b* as illustrated in FIG. 6.

First, a 5% aqueous solution of polyvinyl alcohol (made by Kuraray Co., Ltd., Kuraray Poval PVA 124H; glass transition point: 70°-80° C.) that is incompatible with acrylonitrile-styrene resin at room temperature was applied on the ink layer 3 and the coating was dried by warm air drying at 60° C., whereby a dye-diffusion preventive layer 7 having a thickness of about 1 μm was formed on the ink layer 3. Then, an aqueous dispersion containing as softening transfer material 5 components 20 parts of castor wax (with a melting point of about 85° C., made by Kokuragosei Kogyo) in powder form (about 5 μm in median diameter) and 6 parts of methyl cellulose (made by Shin-Etsu Chemical Co., Ltd.; Metolose SM 15; no transition point above room temperature) in 60 parts of water, was prepared. In the aqueous dispersion was further dispersed 20 parts of particles (median diameter: 5 μm, maximum particle diameter: about 10 μm) of polyvinyl butyral (made by Sekisui Chemical Co., Ltd.; glass transition point: 55° C.), as dye acceptor particles 4, to give a coating solution for particle-transfer layer. The coating solution was applied on the dye-diffusion preventive layer 7 and was then subjected to cool air drying at room temperature, with the result that a white particle-transfer layer 6 having a slightly irregular surface was formed wherein the layer thickness of the softening transfer-material 5 was about 20 μm. The thermal transfer sheet 1 was produced in this way. The particle-transfer layer 6 becomes transparent after heated to be transferred.

This thermal transfer sheet 1 exhibited good formation of image with smooth gradation from the paper surface density to a maximum density of 2.05.

As a trial, polyester particles (with median diameter of 7 μm and maximum particle diameter of about 17 μm) separately (made by Toyobo Co., Ltd.; glass transition point: 67° C.) were used as dye acceptor particles 4. In this case, too, a good quality image with gradation of maximum density of 1.98, was obtained.

Also, a thermal transfer sheet according to the present example type was prepared according to the production method illustrated in FIG. 2. First, a 50 μm thick layer of silicon rubber (made by Toray Silicone Co., Ltd.; SE 9157) was formed on a 50 μm thick polyester film, which was used as a releasable substrate 10. Then, on the surface of this substrate 10 was coated with the above mentioned coating solution for particle-transfer layer. The coating was then subjected to warm air drying at 60° C. and a pressing treatment. Thus, a smooth particle-transfer layer 6 was temporarily formed on the releasable substrate 10. Aforesaid 5% coating solution of polyvinyl alcohol was applied on the ink layer 3 and the coating was slightly dried so as for the coated surface to remain tacky. Then, the particle-transfer layer 6 on the releasable substrate 10 was pressed against the tacky surface and thereby transferred thereonto. The resulting composite was allowed to stand at room temperature for 12 hours. A thermal transfer sheet 1 was thus formed. This sheet had less surface irregularity and, therefore, it could be brought into uniform contact with an image receiving medium. The sheet exhibited good performance such that imperfect transfer possibility was minimized and image quality was improved with a little improvement in maximum density up to 2.12.

A thermal transfer sheet 1 made experimentally in the present example was used for image recording with image data of a linear image. The line image was found to be cut off at several spots, the image being thus of low reproducibility. However, when the heat treatment was controlled as illustrated in FIG. 3 (using a pulse width of 4 ms) so that undyed layer could be formed on opposite sides of the line, a recorded image having good image quality and fixing properties was obtained.

In the present example, of course it is possible to add boric acid, tartaric acid or the like to the dye-diffusion preventive layer 7 in order to avoid any coloration of the polyvinyl alcohol of the dye-diffusion preventive layer 7.

In the foregoing examples mostly referred to monocolor recording, but it is possible to easily obtain a full-color image by superposing three primitive colors as illustrated in Example 2. In such superposed recording, dye acceptor particles 4 for each color are transferred. Therefore, if they are rediffused, they are again transferred, together with softening transfer-material 5, onto the image receiving medium. Thus, it is possible to obtain a high quality recorded image without loss of the coloring material transferred to the image receiving medium. In this case, the thickness of particle-transfer layer 6, the materials and composition of softening transfer-material 5 and dye acceptor particles 4, as well as the material and thickness of dye-diffusion preventive layer 7, may be suitably varied in accordance with the ink layer 3 in each color.

In each example, thermal head is used for selective heading according to image signals; but alternatively a laser oscillator may be used.

In this example, the dye-diffusion preventive layer 7 is composed of a single layer, but of course it can be constituted of plural layers of aqueous material.

In order to compensate for the lack of film-forming properties of the particle-transfer layer 6, it is of course possible to coat the particle-transfer layer 6 with a thin film of aforesaid aqueous materials having good film-forming properties, such as aqueous cellulose and polyvinyl alcohol. Such a film can be formed by applying an aqueous solution containing dissolved aqueous material having good film formability on the surface of the particle-transfer layer 6 by, for example, spray-coating.

Although, in the examples, recording characteristics are evaluated from images recorded on common paper, it is needless to say that recording can be effected on a plastic medium, such as synthetic paper, or any conventional receiving medium having a dye receiving layer.

In the present examples, the dye accepter particles are arranged in one line laminated in the direction of thickness of particle transfer layer, but of course the dye accepter particles are arranged in plural lines laminated in the direction of particle transfer layer.

What is claimed is:

1. A thermal transfer sheet comprising;
a heat resistant sheet-form substrate,
an ink layer containing a dye laminated on the substrate,
a dye-diffusion preventive layer laminated on the ink layer, which comprises a material composed of at least water-soluble cellulose ether and/or polyvinyl alcohol, and
a particle-transfer layer laminated on the dye-diffusion preventive layer, the particle-transfer layer comprising at least a softening transfer-material whose viscosity will be lowered by heating and dye acceptor particles of a dyeable thermoplastic resin dispersed in the softening transfer-material.

2. The thermal transfer sheet of claim 1, wherein the dye-diffusion preventive layer is comprised of polyvinyl alcohol.

3. The thermal transfer sheet of claim 1, wherein the dye-diffusion preventive layer comprises the aqueous material being crosslinked with glyoxal.

4. The thermal transfer sheet of claim 1, wherein the softening transfer-material is comprised of polyethylene glycol.

5. The thermal transfer sheet of claim 1, wherein the softening transfer-material is comprised of a wax dispersed in:
a material composed of at least one member selected from the group consisting of polyethylene glycol, natural polysaccharide, starch, collagen, gelatin, agar-agar, water-soluble alkyd resin, alginate, poly acrylate, water-soluble acrylic resin, water-soluble cellulose ether and polyvinyl alcohol.

6. A thermal transfer sheet comprising;
a heat resistant sheet-form substrate,
an ink layer comprising a dye laminated on the substrate,
a dye-diffusion preventive layer comprised of polyvinyl alcohol and laminated on the ink layer,
and a particle-transfer layer laminated on the dye-diffusion preventive layer, the particle-transfer layer comprising wax particles of a wax and dye acceptor particles of a dyeable thermoplastic resin, dispersed in a material composed of at least one member selected from the group consisting of polyethylene glycol, natural polysaccharide, starch, collagen, gelatin, agar-agar, water-soluble acrylic resin, water-soluble cellulose ether and polyvinyl alcohol.

7. A thermal transfer sheet comprising;
a heat resistant sheet-form substrate,
an ink layer comprising a dye laminated on the substrate,
a dye-diffusion preventive layer comprised of an aqueous material crosslinked with glyoxal, the material being composed of at least water-soluble cellulose ether and/or polyvinyl alcohol, and
a particle-transfer layer laminated on the dye-diffusion preventive layer, which comprises;
a softening transfer-material containing a material composed of at least one member selected from the group consisting of polyethylene glycol, natural polysaccharide, starch, collagen, gelatin, agar-agar, water-soluble alkyd resin, alginate, poly acrylate, water-soluble acrylic resin, water-soluble cellulose ether and polyvinyl alcohol and an organic acid salt, and dye acceptor particles of a dyeable thermoplastic resin dispersed in the softening transfer-material.

8. A thermal transfer recording method which employ;
a thermal transfer sheet comprises a heat resistant sheet-form substrate,
an ink layer containing a dye laminated on the substrate,
a dye-diffusion preventive layer comprising a material composed of at least water-soluble cellulose ether and/or polyvinyl alcohol, and laminated on the ink layer, and
a particle-transfer layer laminated on the dye-diffusion preventive layer, the particle-transfer layer comprising at least a softening transfer-material whose viscosity will be lowered by heating and dye acceptor particles of a dyeable thermoplastic resin dispersed in the softening transfer-material,
said method comprising holding the thermal transfer sheet between a thermal head and an image receiving medium and selectively heating said sheet through the thermal head according to an image signal, said heating being effected in such a way that at least a non-image-signal portion of the particle-transfer layer which is located adjacently to or spaced a plurality of picture elements apart from the image signal may be transferred onto the image receiving medium by modifying the image signal to heat the non-image-signal portions through the thermal head.

* * * * *